US006946230B2

(12) United States Patent
Stelter et al.

(10) Patent No.: US 6,946,230 B2
(45) Date of Patent: Sep. 20, 2005

(54) ELECTROSTATIC IMAGE DEVELOPING PROCESSES AND COMPOSITIONS

(75) Inventors: Eric C. Stelter, Pittsford, NY (US); Joseph E. Guth, Holley, NY (US); Ulrich Mutze, Bad Ditzenbach (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 9 days.

(21) Appl. No.: 10/054,514

(22) Filed: Nov. 13, 2001

(65) Prior Publication Data

US 2003/0091921 A1 May 15, 2003

(51) Int. Cl.[7] ..... G03G 9/00

(52) U.S. Cl. ..... 430/110.4; 430/111.4; 430/111.41

(58) Field of Search ..... 430/110.4, 111.4, 430/111.41

(56) References Cited

U.S. PATENT DOCUMENTS

| | | | | |
|---|---|---|---|---|
| 3,895,125 A | * | 7/1975 | Tsuchiya et al. | 430/122 |
| 4,473,029 A | | 9/1984 | Fritz et al. | 118/657 |
| 4,496,643 A | | 1/1985 | Wilson et al. | 430/110 |
| 4,531,832 A | | 7/1985 | Kroll et al. | 355/3 |
| 4,546,060 A | | 10/1985 | Miskinis et al. | 430/108 |
| 4,602,863 A | | 7/1986 | Fritz et al. | 355/3 |
| 4,634,286 A | | 1/1987 | Pike | 366/320 |
| 4,637,973 A | | 1/1987 | Shigeta et al. | 430/122 |
| 4,671,207 A | | 6/1987 | Hilbert | 118/657 |
| 4,714,046 A | | 12/1987 | Steele et al. | 118/657 |
| 4,764,445 A | | 8/1988 | Miskinis et al. | 430/108 |
| 4,825,244 A | | 4/1989 | Hediger | 355/3 |
| 4,887,132 A | | 12/1989 | Joseph et al. | 355/253 |
| 4,922,302 A | | 5/1990 | Hill et al. | 355/251 |
| 4,949,127 A | | 8/1990 | Matsuda et al. | 355/251 |
| 4,967,236 A | | 10/1990 | Rodenberg et al. | 355/272 |
| 5,001,028 A | | 3/1991 | Mosehauer et al. | 430/45 |
| 5,019,796 A | | 5/1991 | Lee et al. | 335/302 |
| 5,040,003 A | | 8/1991 | Willis | 346/157 |
| 5,043,760 A | | 8/1991 | MacLellan et al. | 355/296 |
| 5,047,807 A | | 9/1991 | Kalyandurg | 355/269 |
| 5,049,471 A | | 9/1991 | Higashiguchi et al. | 430/122 |
| 5,061,586 A | | 10/1991 | Saha et al. | 430/108 |
| 5,063,399 A | | 11/1991 | Zeman et al. | 346/160.1 |
| 5,066,981 A | | 11/1991 | Kalyandurg | 355/245 |
| 5,084,739 A | | 1/1992 | Kalyandurg et al. | 355/299 |
| 5,095,340 A | | 3/1992 | Mahoney | 355/251 |
| 5,104,761 A | | 4/1992 | Saha et al. | 430/106.6 |
| 5,106,714 A | | 4/1992 | Saha et al. | 430/106.6 |
| 5,111,245 A | | 5/1992 | DeCecca et al. | 355/245 |
| 5,132,732 A | | 7/1992 | Kalyandurg et al. | 355/245 |
| 5,138,388 A | | 8/1992 | Kamp et al. | 355/251 |
| 5,146,278 A | | 9/1992 | Kroll et al. | 355/253 |
| 5,148,220 A | | 9/1992 | Hilbert et al. | 355/245 |
| 5,162,854 A | | 11/1992 | Hilbert et al. | 355/245 |
| 5,182,608 A | | 1/1993 | Kroll et al. | 355/326 |
| 5,184,194 A | | 2/1993 | Mosehauer et al. | 355/297 |
| 5,190,841 A | | 3/1993 | Saha et al. | 430/106.6 |
| 5,190,842 A | | 3/1993 | Saha et al. | 430/106.6 |
| 5,196,887 A | | 3/1993 | Hilbert et al. | 355/251 |
| 5,227,265 A | | 7/1993 | DeBoer et al. | 430/41 |
| 5,237,127 A | | 8/1993 | DeCecca et al. | 118/645 |
| 5,239,342 A | | 8/1993 | Kubo et al. | 355/245 |
| 5,241,327 A | | 8/1993 | Rubin et al. | 346/76 |
| 5,245,388 A | | 9/1993 | Rydelek et al. | 355/245 |
| 5,247,331 A | | 9/1993 | Rydelek | 355/245 |
| 5,255,053 A | | 10/1993 | Green et al. | 355/200 |
| 5,268,249 A | | 12/1993 | Saha et al. | 430/106.6 |
| 5,268,719 A | | 12/1993 | Rydelek et al. | 355/245 |
| 5,280,302 A | | 1/1994 | Rubin et al. | 346/762 |
| 5,282,002 A | | 1/1994 | Jacobs et al. | 355/245 |
| 5,291,259 A | | 3/1994 | Weitzel et al. | 355/306 |
| 5,293,201 A | | 3/1994 | Kamp et al. | 355/269 |
| 5,296,894 A | | 3/1994 | Green et al. | 355/200 |
| 5,296,898 A | | 3/1994 | Rubin et al. | 355/245 |
| 5,296,905 A | | 3/1994 | Yousey et al. | 355/305 |
| 5,298,358 A | | 3/1994 | Rubin et al. | 430/126 |
| 5,300,988 A | | 4/1994 | Westbrook et al. | 355/253 |
| 5,306,592 A | | 4/1994 | Saha | 430/137 |
| 5,313,993 A | | 5/1994 | Corby et al. | 141/364 |
| 5,325,161 A | | 6/1994 | Saha et al. | 355/251 |
| 5,332,645 A | | 7/1994 | Saha et al. | 430/137 |
| 5,339,140 A | | 8/1994 | Zeman et al. | 355/246 |

(Continued)

FOREIGN PATENT DOCUMENTS

| | | |
|---|---|---|
| JP | 03-170978 | 7/1991 |
| JP | 04-097268 | 3/1992 |
| JP | 10-161423 | 6/1998 |
| WO | WO 85/00438 | 1/1985 |

OTHER PUBLICATIONS

Williams, E.N., "The Physics and Technology of Xerographic Processes", pp. 145–153 Krieger Publishing Company, Malabar Florida (1993).

Schien, L. B. "Electrophotography and Development Physics", pp. 140–152, Laplacian Press, Morgan Hill, California (1996).

Feng, J. Q. and Hays, D. A. "Theory of Electric Field Detachment of Charged Toner Particles", IS&Ts NIP 14: 1998 International Conference on Digital Printing Technologies, pp. 374–377.

Feng, J. Q. and Hays, D. A. "Theory of Electric Field Detachment of Charged Toner Particles in Electrophotography", Journal of Imaging Science and Technology, vol. 44, No. 1, Jan./Feb. 2000, pp. 19–25.

Halsey, T. C. "Electrorheological Fluids", Science, vol. 258, Oct. 30, 1992, pp. 761–766.

(Continued)

*Primary Examiner*—Mark A. Chapman

(57) ABSTRACT

Compositions and methods for electrographic image development, wherein the image development process employs a two-component developer that includes toner particles having a radius $R_T$ and magnetic carrier particles having a radius $R_C$, wherein $R_C$ is preferably less than about $5R_T$ and is more preferably less than or equal to about $3R_T$.

25 Claims, 14 Drawing Sheets

U.S. PATENT DOCUMENTS

| | | | | | |
|---|---|---|---|---|---|
| 5,344,731 | A | | 9/1994 | Deboer et al. | 430/41 |
| 5,347,345 | A | | 9/1994 | Osterhoudt | 355/246 |
| 5,347,347 | A | | 9/1994 | Hilbert et al. | 355/253 |
| 5,376,492 | A | | 12/1994 | Stelter et al. | 430/122 |
| 5,400,124 | A | | 3/1995 | Kass et al. | 355/251 |
| 5,409,791 | A | | 4/1995 | Kaukeinen et al. | 430/54 |
| 5,484,680 | A | | 1/1996 | Goto et al. | 430/122 |
| 5,489,975 | A | | 2/1996 | Kaukeinen et al. | 355/251 |
| 5,500,320 | A | | 3/1996 | Saha | 430/106.6 |
| 5,512,404 | A | | 4/1996 | Saha | 430/106.6 |
| 5,592,268 | A | | 1/1997 | Uehara et al. | 399/276 |
| 5,640,656 | A | | 6/1997 | Hilbert et al. | 399/273 |
| 5,701,550 | A | | 12/1997 | Lofftus et al. | 399/44 |
| 5,705,307 | A | | 1/1998 | Tyagi et al. | 430/120 |
| 5,713,064 | A | | 1/1998 | Kasiske et al. | 399/99 |
| 5,732,311 | A | | 3/1998 | May et al. | 399/159 |
| 5,748,218 | A | | 5/1998 | Stelter et al. | 347/158 |
| 5,835,832 | A | | 11/1998 | Rimai et al. | 399/308 |
| 5,853,941 | A | | 12/1998 | Rimai et al. | 430/122 |
| 5,866,289 | A | * | 2/1999 | Asanae et al. | 430/111.41 |
| 5,923,933 | A | | 7/1999 | Anzai et al. | 399/269 |
| 5,923,937 | A | | 7/1999 | Thompson et al. | 399/302 |
| 5,926,679 | A | | 7/1999 | May et al. | 399/296 |
| 5,998,076 | A | | 12/1999 | Mahabadi et al. | 430/106.6 |
| 6,101,358 | A | | 8/2000 | Imai et al. | |
| 6,125,257 | A | | 9/2000 | Sekine et al. | 399/343 |
| 6,526,247 | B2 | | 2/2003 | Stelter et al. | |
| 2002/0022190 | A1 | * | 2/2002 | Iizuka et al. | 430/110.4 |
| 2002/0168200 | A1 | | 11/2002 | Stelter et al. | |

OTHER PUBLICATIONS

Bernal, J. D., Geometry of the Structure of Monatomic Liquids, Nature, vol. 185, (1960) pp. 68–70.

Bernal, J. D., Co–ordination of Randomly Packed Spheres, Nature, vol. 188, (1960) pp. 910–911.

Finney, J. L., Amorphous Metallic Alloys, ed F. E. Luborsky (Butterworths, London, 1983) pp. 42–56.

Moorjani, K and Coey, J. M. D., Magnetic Glasses, (Elsevier 1984) pp. 75–76.

Torquato, S., Lu. B., and Rubenstein, J. "Nearest–neighbor distribution functions in many–body systems", Phys. Rev. A, vol. 45, No. 8 (Feb. 15, 1990), pp. 2059–2075.

Lu, and Torquato, S., "Nearest–surface distribution functions for polydispersed particle systems", Physical Review A, vol. 45, No. 8 (Apr. 15, 1992), pp. 5530–5544.

Bernal, J.D., The Bakerian Lecture, 1962, "The Structure of Liquids", Proc. Roy. Soc. A, vol. 280 (Jul. 28, 1964), pp. 299–321 and Plates 14–17.

B. Lu and S. Torquato, Nearest–surface distribution functions for polydispersed particle systems, Phys. Rev. A 45, 5530–5544 (1992).

S. Torquato, B. Lu, and J. Rubinstein, Nearest–neighbor distribution functions in many–body systems, Phys. Rev. A 41, 2059–2075 (1990).

* cited by examiner

Figure 6:
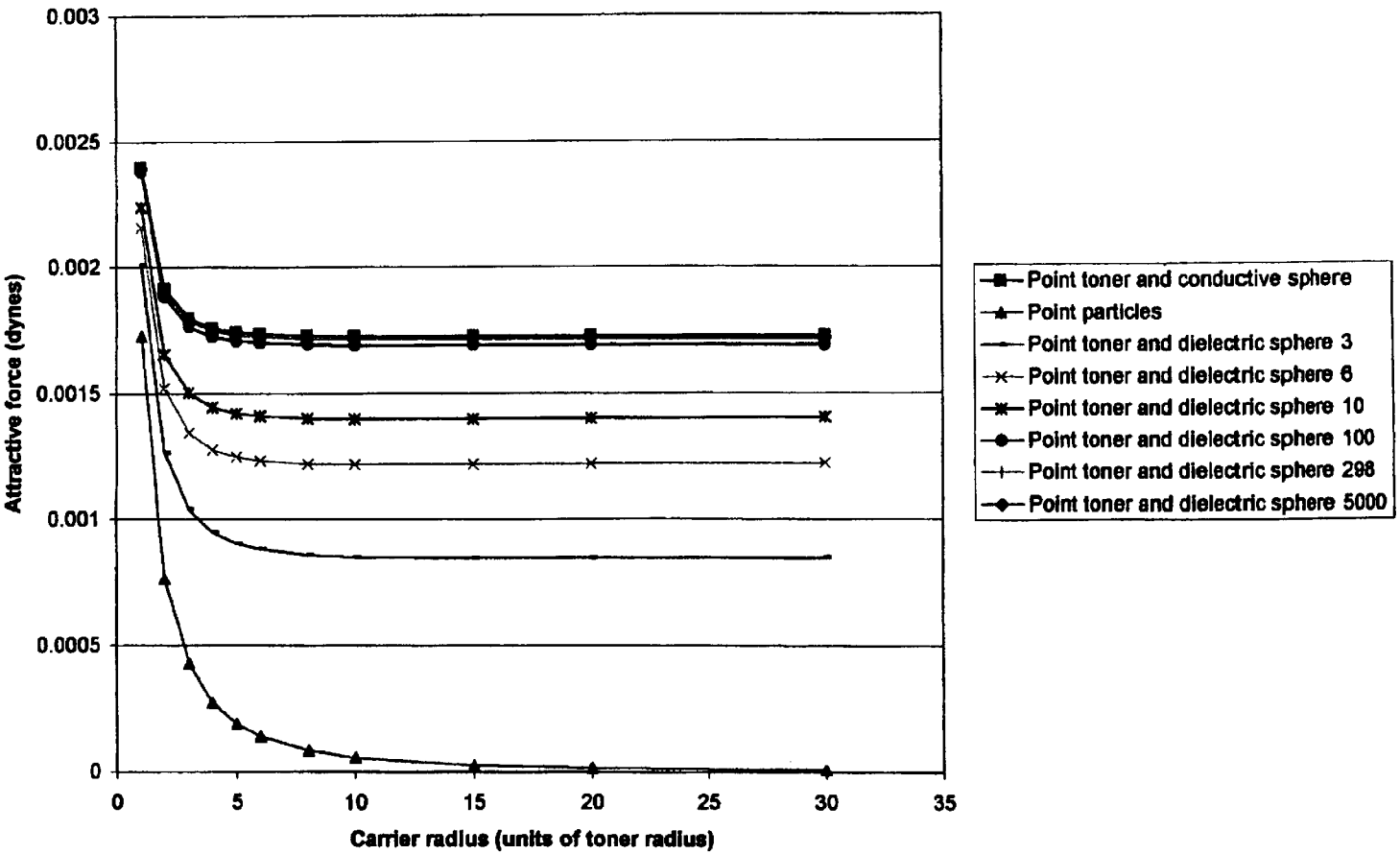

Fig. 6 Force on toner particle

Figure 7:
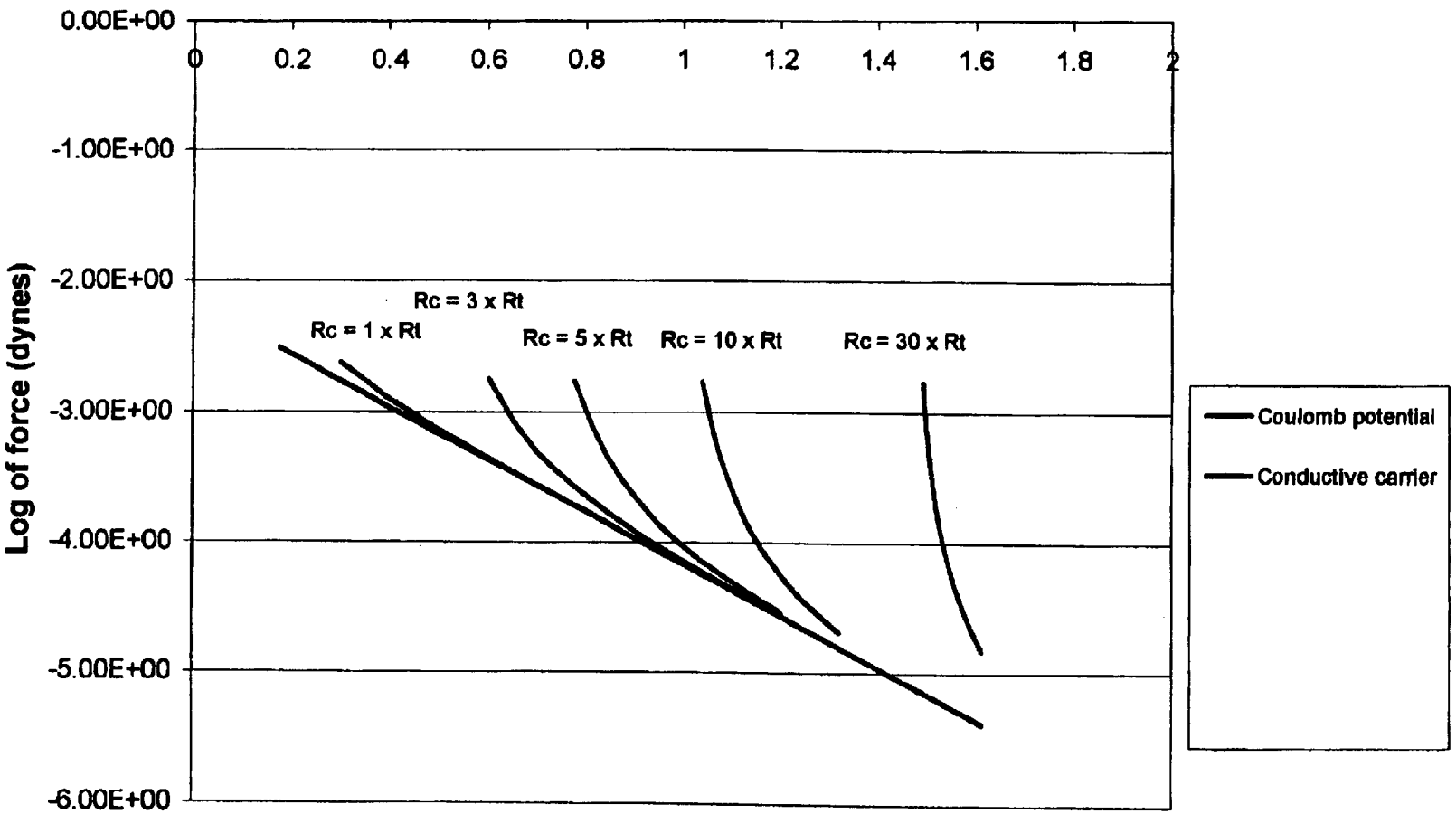

Fig. 7 Force as a function of carrier size

Figure 9:
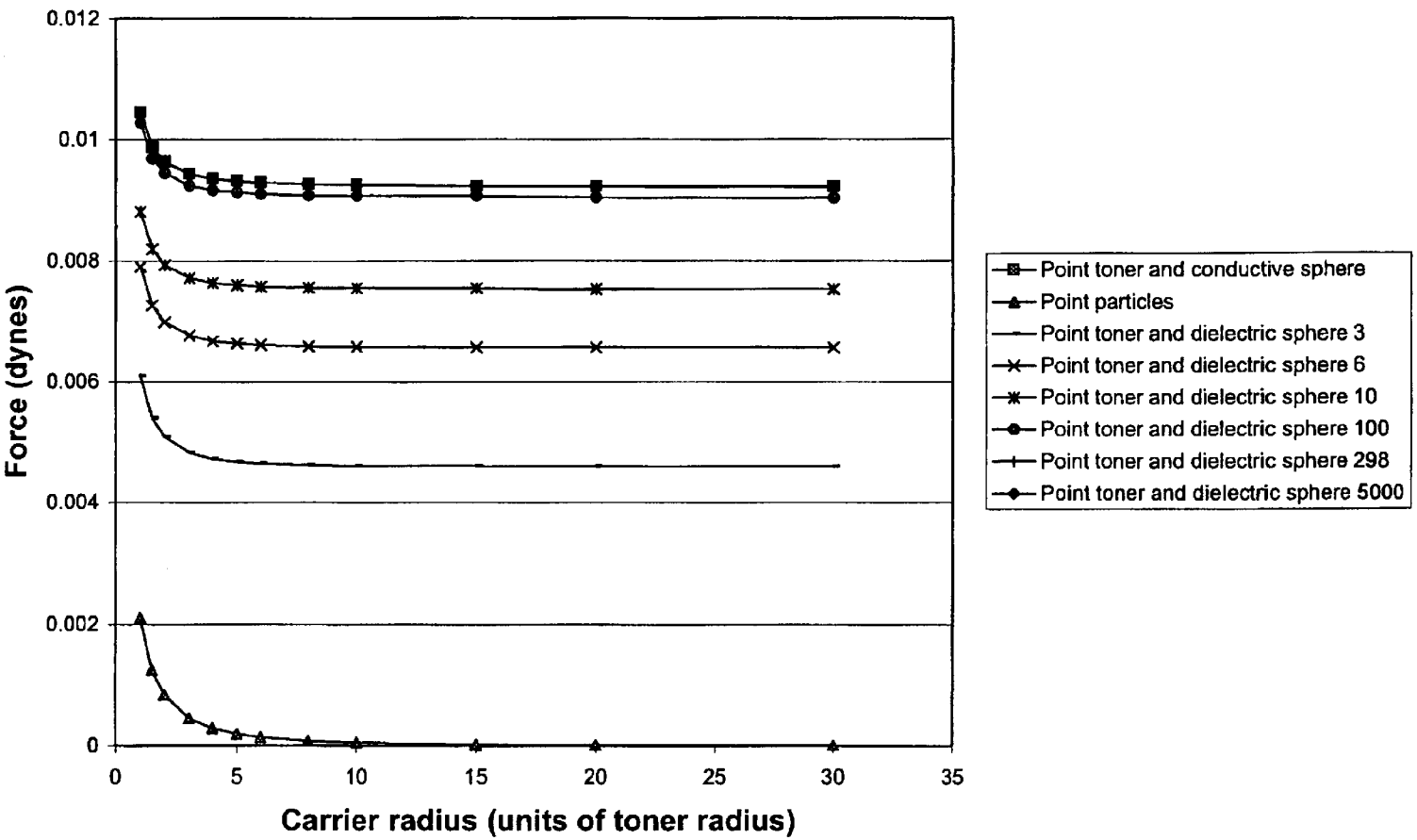

Fig. 9 Force on toner particle: 0.1 q concentrated on surface

Figure 11:
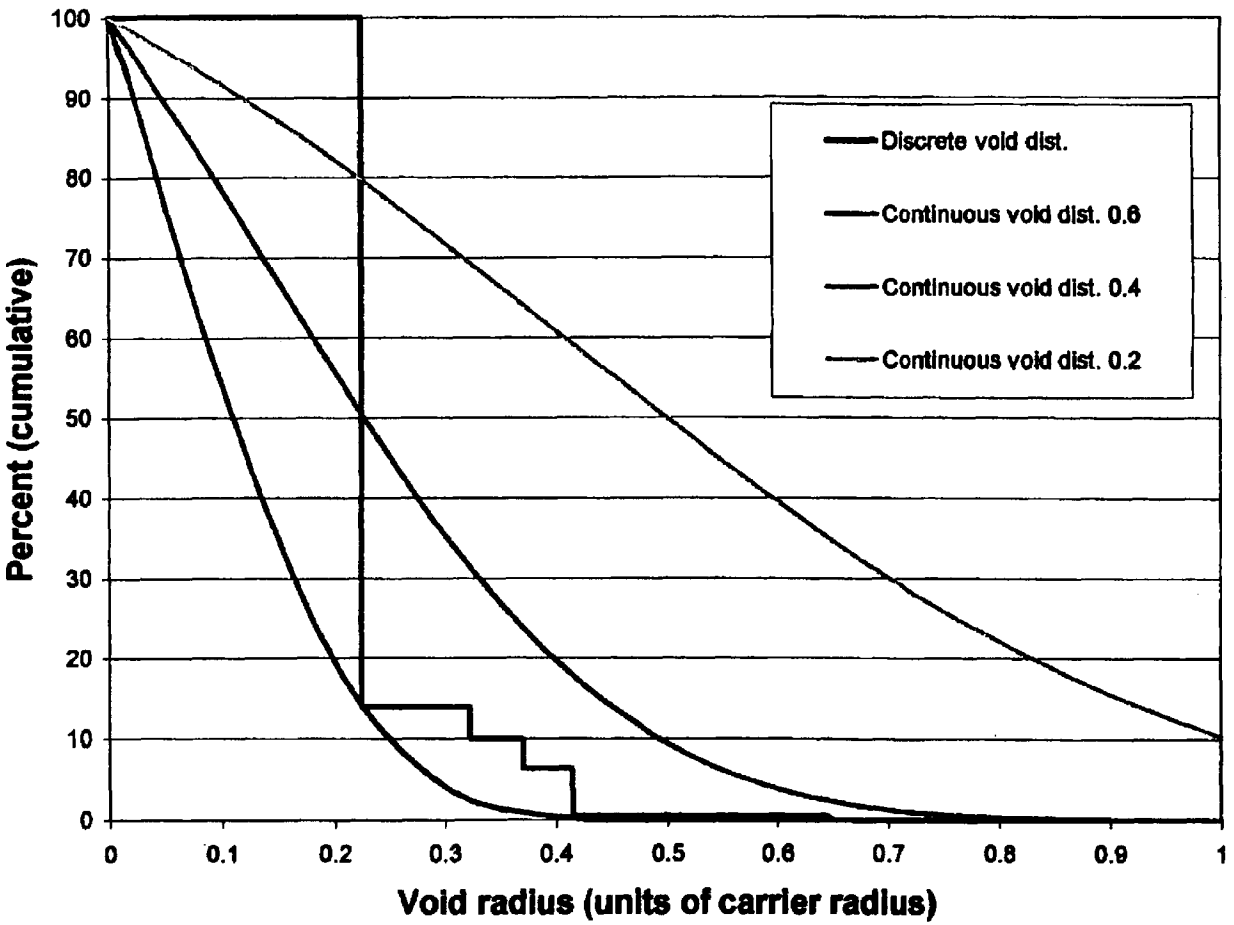

Fig. 11 Void sizes in drphs model
Monodisperse particles with packing fraction 0.6 to 0.2

Fig. 13 Schulz distribution
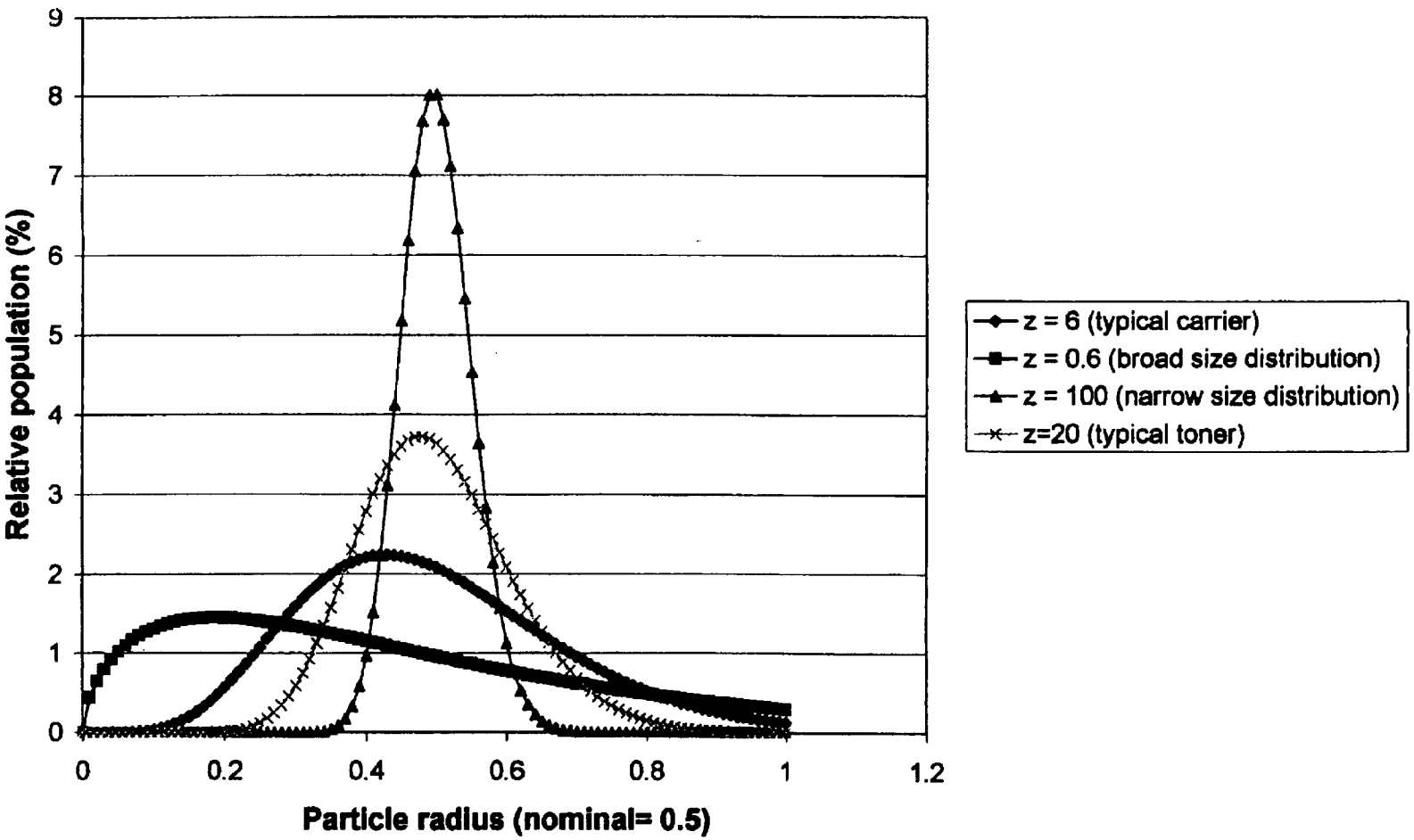

Fig. 14 Void sizes in drphs model
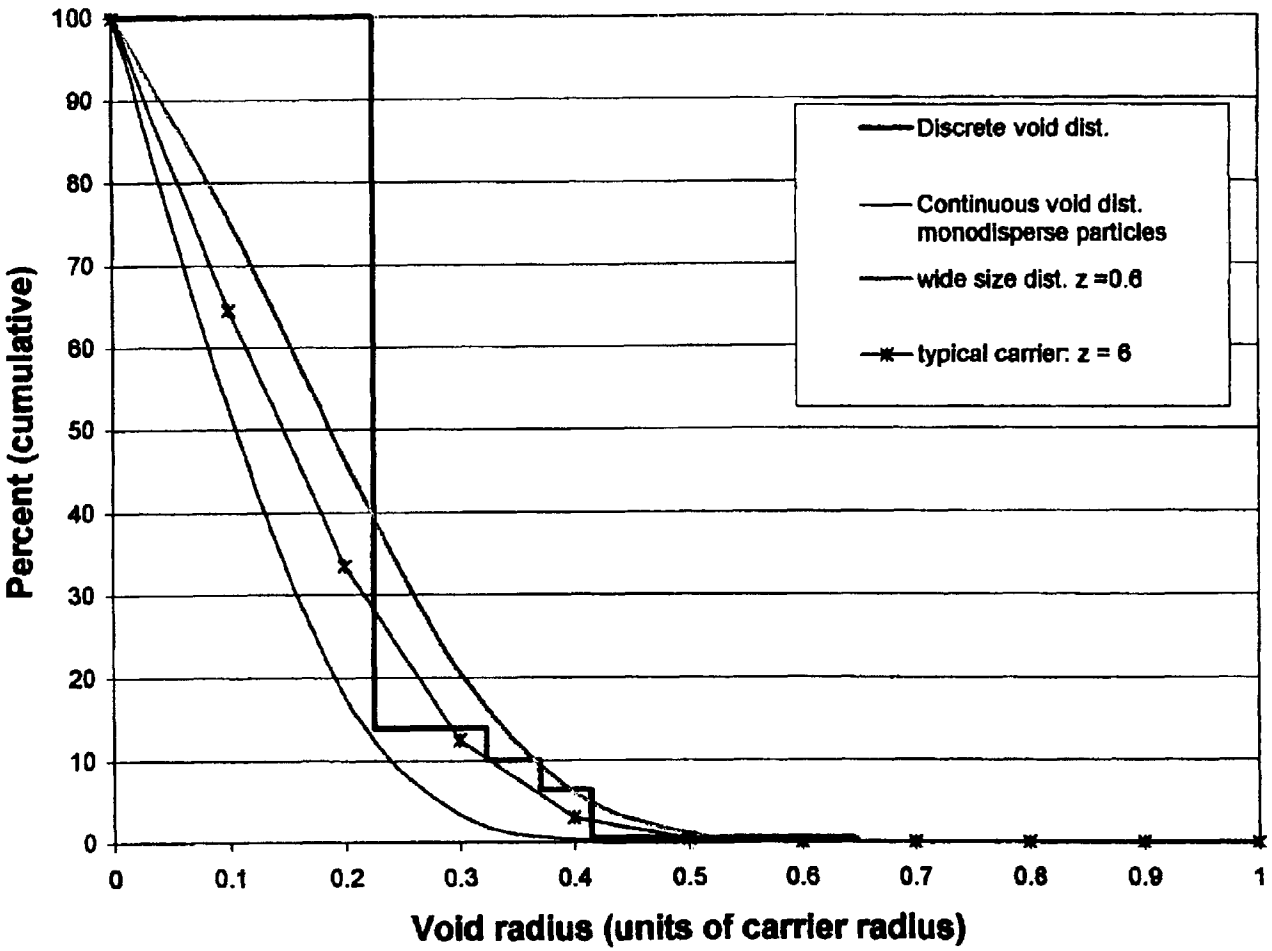

ELECTROSTATIC IMAGE DEVELOPING PROCESSES AND COMPOSITIONS

BACKGROUND OF THE INVENTION

The invention relates generally to processes for electrostatic image development in toning systems that employ a two-component developer. More specifically, the invention relates to apparatus and methods for electrostatic image development, wherein the image development process is optimized by manipulating certain relationships between carrier particle size, toner particle size, carrier dielectric constant or conductivity, and toner charge to minimize attractive forces between the toner particles and carrier particles that arise from the effects of particle polarization and non-uniform surface charge distributions.

Processes for developing electrostatic images using dry toner are well known in the art. Such development systems are used in many electrophotographic printers and copiers (collectively referred to herein as "electrophotographic printers" or "printers") and typically employ a developer consisting of toner particles, hard magnetic carrier particles and other components. In many current and prior art developers, the carrier particles arc much larger than the toner particles, on the order of up to 30 times larger.

The developer is moved into proximity with an electrostatic image carried on a photoconductor, whereupon the toner component of the developer is transferred to the photoconductor, prior to being transferred to a sheet of paper to create the final image. Developer is moved into proximity with the photoconductor by a rotating toning shell, an electrically-biased, conductive metal roller that is rotated cocurrent with the photoconductor, such that the opposing surfaces of the photoconductor and toning shell travel in the same direction. Located inside the toning shell is a multipole magnetic core, having a plurality of magnets, that is either fixed relative to the toning shell or that rotates, usually in the opposite direction of the toning shell. The developer is deposited on the toning shell and the toning shell rotates the developer into proximity with the photoconductor, at a location where the photoconductor and the toning shell are in closest proximity, referred to as the "toning nip."

On the toning shell, the magnetic carrier component of the developer forms a "nap," similar in appearance to the nap of a fabric, because the magnetic particles form chains of particles that rise vertically from the surface of the toning shell in the direction of the magnetic field. The nap height is maximum when the magnetic field from either a north or south pole is perpendicular to the toning shell. Adjacent magnets in the magnetic core have opposite polarity and, therefore, as the magnetic core rotates, the magnetic field also rotates from perpendicular to the toning shell to parallel to the toning shell. When the magnetic field is parallel to the toning shell, the chains collapse onto the surface of the toning shell and, as the magnetic field again rotates toward perpendicular to the toning shell, the chains also rotate toward perpendicular again. Thus, the carrier chains appear to flip end over end and "walk" on the surface of the toning shell and, when the magnetic core rotates in the opposite direction of the toning shell, the chains walk in the direction of photoconductor travel.

The toner component of the developer is carried along with the carrier particles by virtue of the attractive forces that cause the toner particles to bind to the carrier particles. These forces include surface forces, or adhesion forces, such as van der Waals forces, and electrostatic forces arising from both free charges, such as tribocharge, and bound charges due to polarization induced by those charges and polarization of the particles by the external electric field of image development. Surface forces are important for small toner particles but are generally of very short range and are only significant for particles in contact. However, tribocharging can produce patches of charge at the point of contact between particles, causing uneven charge distribution that can result in a very large attractive force between particles.

While these attractive forces are required to transport toner into the toning nip, image development cannot occur unless the toner particles are separated from the carrier particles. Accordingly, it is important for optimal image development to strike an appropriate balance, such that the attractive forces between the toner and carrier particles are strong enough to efficiently transport toner while at the same time the attractive forces should not be so strong as to interfere with stripping of toner particles from the developer in the presence of the force due to the imaging field, or toner development will be impaired. Accordingly, there is a need in the art for developer and developer systems that strike the appropriate balance by minimizing unwanted components of the attractive forces between toner and carrier particles, allowing for optimal toning efficiency.

SUMMARY

This invention solves these and other problems of the current and prior art developer systems by optimizing the relative sizes of the carrier and toner particles so that the creation of non-uniform distributions of electrostatic charge on the particles and the force due to non-uniform charge distributions are minimized. In one aspect, the present invention is directed to a two-component developer, in which the carrier particles are only a few times larger than the toner particles.

In another aspect, the invention relates to a two-component developer, including magnetic carrier particles and resinous, pigmented toner particles, wherein the dielectric constant or conductivity of the toner and carrier are determined such that the forces due to non-uniform charge distributions are minimized.

BRIEF DESCRIPTION OF THE DRAWINGS AND PREFERRED EMBODIMENTS

Figure 1:
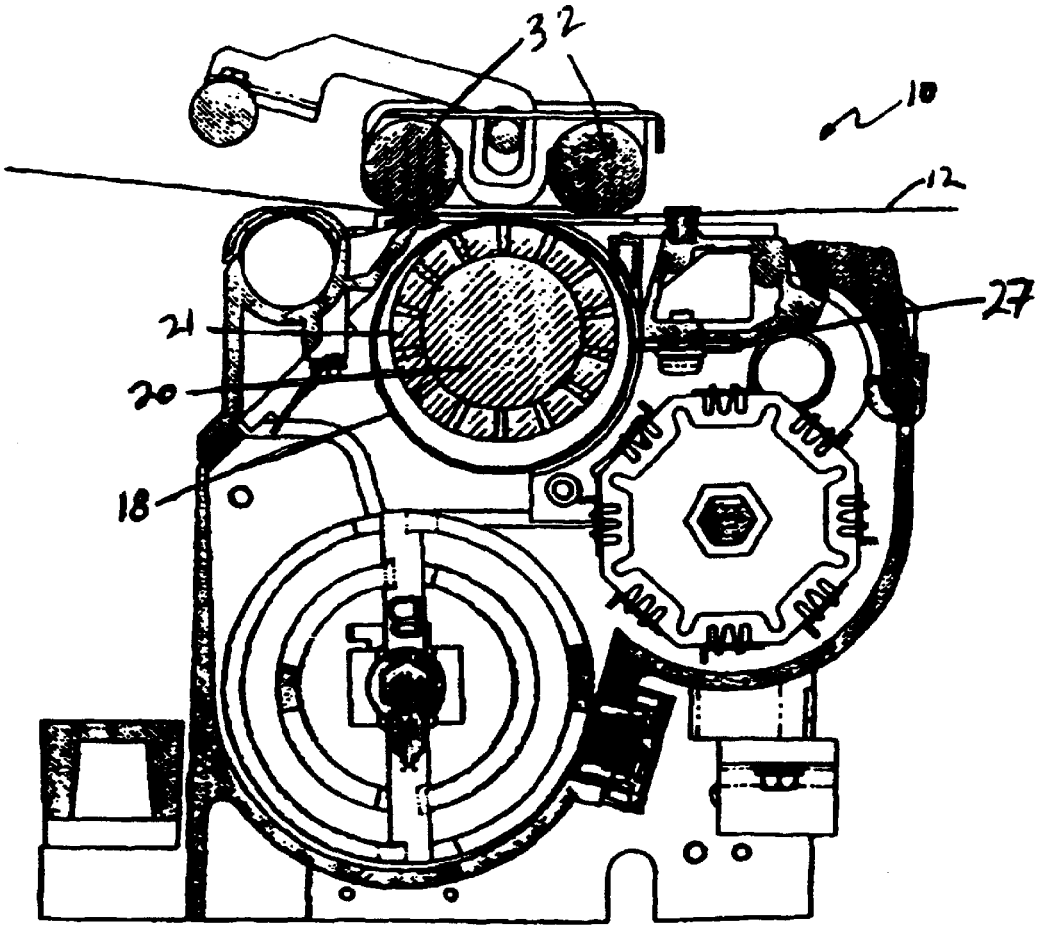

FIG. 1 presents a side view of an apparatus for developing electrophotographic images, according to an aspect of the invention.

Figure 2:
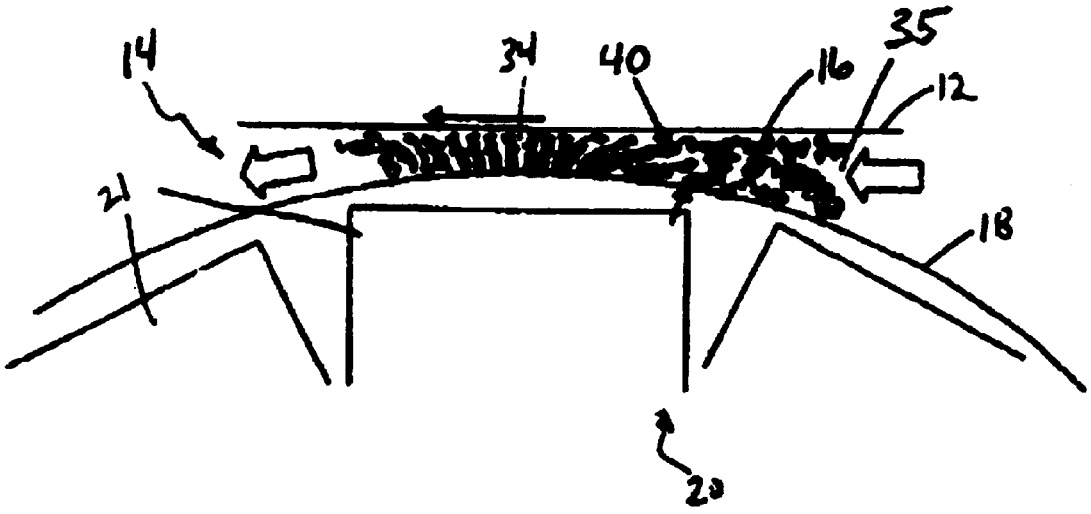

FIG. 2 presents a side cross-sectional view of an apparatus for developing electrostatic images, according to an aspect of the present invention.

Figure 3:
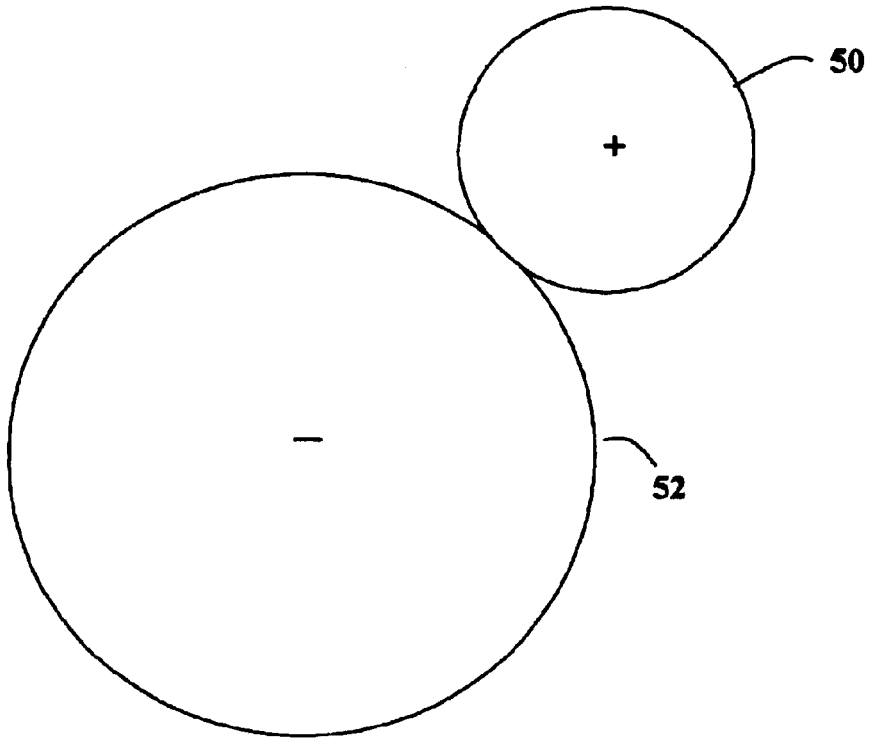

FIG. 3 presents a diagrammatic view of the interaction between a toner particle and a carrier particle having equal and opposite charges.

Figure 4:
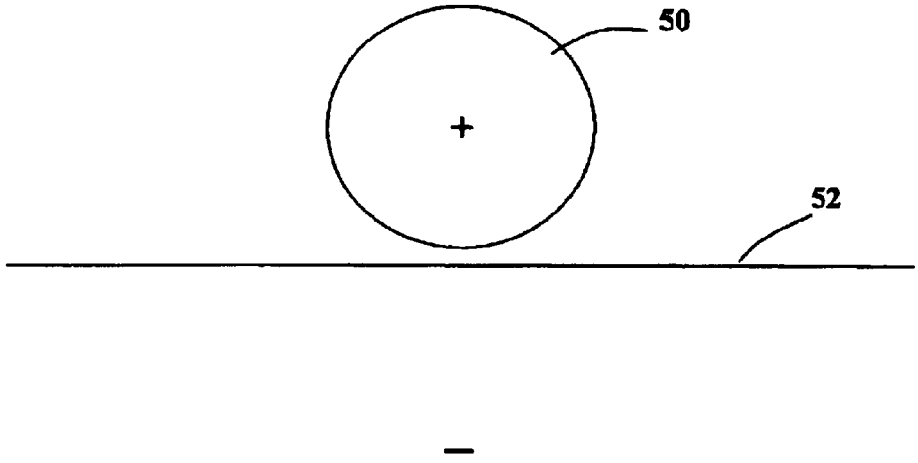

FIG. 4 presents a diagrammatic view of the interaction between a toner particle and a carrier particle having a much greater radius than the toner particle.

Figure 5:
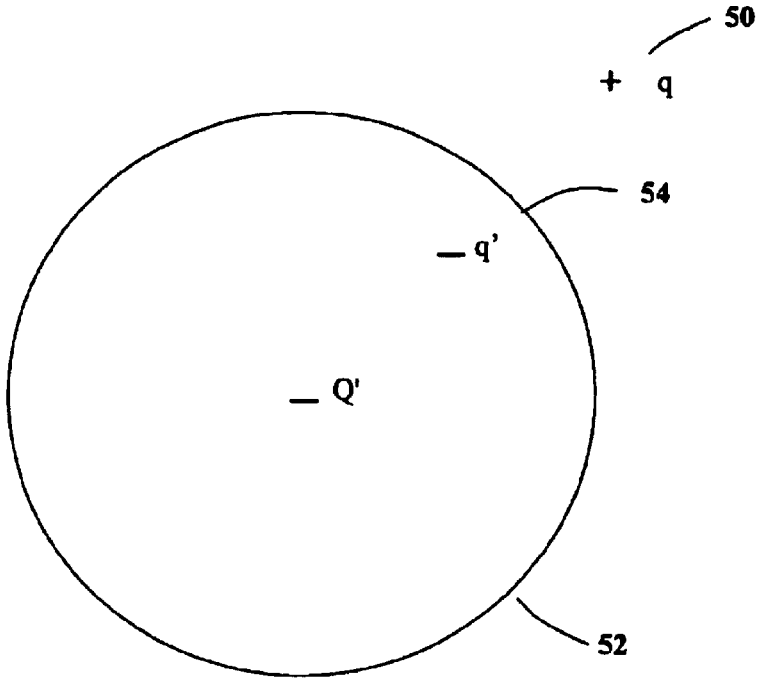

FIG. 5 presents a diagrammatic view of the effects of charge induced polarization for a conductive, spherical carrier particle.

FIG. 6 presents a graphical representation of the inter-particle attractive force between a carrier particle and a toner particle as a function of carrier size and electrical properties for the toner and carrier particles in contact.

FIG. 7 presents a graphical representation of the inter-particle attractive force between a carrier particle and a toner particle as a function of carrier size for a range of separation distances.

Figure 8:
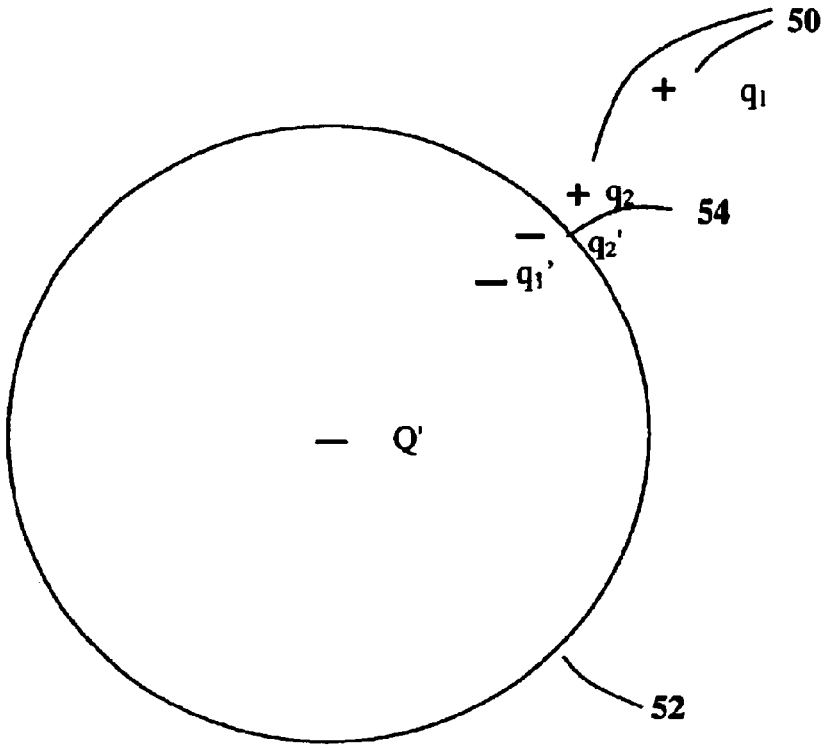

FIG. 8 presents a diagrammatic representation of the interaction between a toner particle showing non-uniform charge distribution and a carrier particle.

FIG. 9 presents a graphical representation of the inter-particle attractive force between a carrier particle and a toner particle as a function of carrier size and electrical properties for the toner and carrier particles separated by a distance of 0.05 toner radii and for 10% of the toner charge concentrated at the point nearest the carrier surface.

Figure 10:
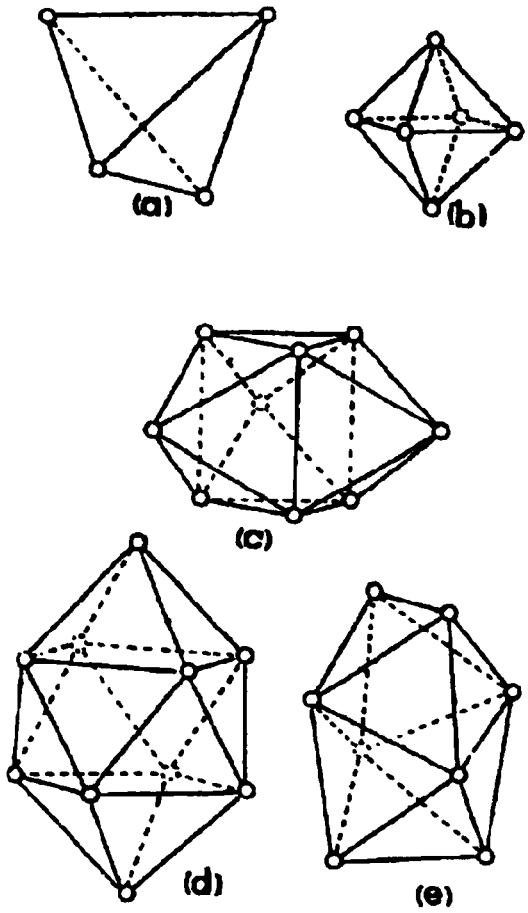

FIG. 10A presents a diagrammatic representation of a tetrahedral void formed by packed carrier particles.

FIG. 10B presents a diagrammatic representation of an octahedral void formed by packed carrier particles.

FIG. 10C presents a diagrammatic representation of a trigonal prism capped with three half octahedra void formed by packed carrier particles.

FIG. 10D presents a diagrammatic representation of an archimedean antiprism capped with two half octahedra void formed by packed carrier particles.

FIG. 10E presents a diagrammatic representation of a tetragonal dodecahedral void formed by packed carrier particles.

FIG. 11 presents a graphical representation of the void size distribution in a dense randomly packed hard spheres model.

Figure 12:
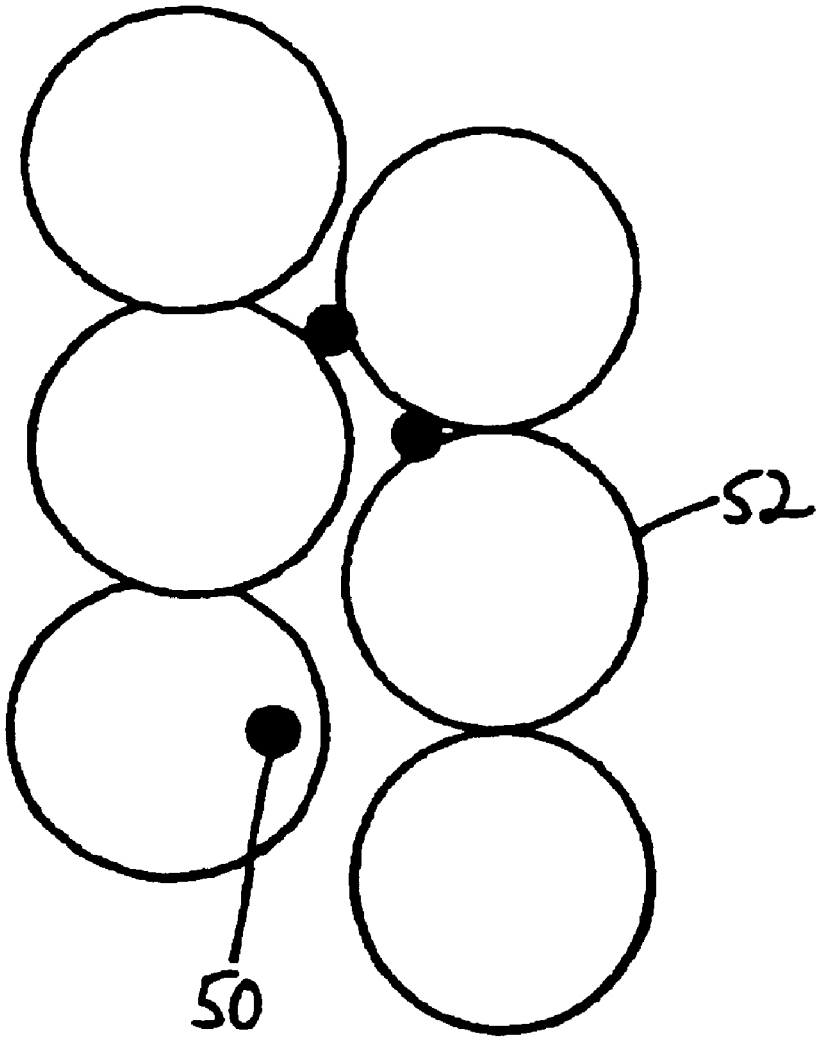

FIG. 12 presents a diagrammatic view of the packing of carrier and toner particles when the carrier particles are much larger than the toner particles.

FIG. 13 presents a graphical representation of particle size distributions

FIG. 14 presents a graphical representation of the void size distribution in a dense randomly packed hard spheres model for carrier particles having narrow and broad size distributions.

DETAILED DESCRIPTION

Various aspects of the invention are presented in FIGS. 1–14, which are not drawn to scale, and wherein like components in the numerous views are numbered alike. FIGS. 1 and 2 depict an electrophotographic printing apparatus according to an aspect of the invention. An apparatus 10 for developing electrostatic images is presented comprising an electrostatic imaging member 12 (also referred to herein as a "photoconductor") on which an electrostatic image is generated, and a magnetic brush 14 comprising a rotating toning shell 18, a mixture 16 of hard magnetic carriers and toner (also referred to herein as "developer"), and a rotating magnetic core 20, comprising a plurality of magnets 21, located inside the toning shell 18. In a preferred embodiment, the photoconductor 12 is configured as a sheet-like film. However, it may be configured in other ways, such as a drum, depending upon the particular application. The film photoconductor 12 is relatively resilient, typically under tension, and a pair of backer bars 32 may be provided that hold the imaging member in a desired position relative to the toning shell 18, as shown in FIG. 1. The photoconductor 12 and the toning shell 18 rotate such that the opposing surfaces of the toning shell 18 and the photoconductor 12 travel in the same direction. The photoconductor 12 and the toning shell 18 define an area therebetween known as the toning nip 34. Developer 16 is delivered to the toning shell 18 upstream from the toning nip 34 and, as the developer 16 is applied to the toning shell 18, the average velocity of developer 16 through the narrow toning nip 34 is initially less than the developer 16 velocity on other parts of the toning shell 18. Therefore, developer 16 builds up immediately upstream of the toning nip 34, in a so-called "rollback zone," until sufficient pressure is generated in the toning nip 34 to compress the developer 16 to the extent that it moves at the same mass velocity as the developer 16 on the rest of the toning shell 18. A metering skive 27 is located adjacent the toning shell 18 and may be positioned closer to or further away from the toning shell 18 to adjust the amount of developer 16 delivered by the toning shell 18.

In a preferred embodiment, the toning station has a nominally 2" diameter stainless steel toning shell containing a 14 pole magnetic core. Each alternating north and south pole has a field strength of approximately 1000 gauss. The toner particles have a nominal diameter of 11.5 microns= $2R_T$ where $R_T$ is the nominal radius of the toner, while the hard magnetic carrier particles have a nominal diameter of approximately 26 microns=$2R_C$ where $R_C$ is the nominal radius of the carrier particles, and resistivity of $10_{11}$ ohm-cm.

While not wishing to be bound by any particular theory, it is believed that the optimization of the relative sizes of the toner and carrier particles affects the electrostatic forces exerted on and between the particles. Accordingly, the following discussions will focus on the interactions between a single toner particle having charge q and a single carrier particle having charge Q, beginning with the simplest force interaction in the ideal situation and will progressively become more complex, as additional forces are taken into account. The toner particles 50 and carrier particles 52 are both electrostatically charged, and have opposite charges, causing the toner particles 50 and carrier particles 52 to be attracted to each other.

Referring to FIG. 3, if the electrostatic charge is uniformly distributed on the surface of the particles and the particles are approximately spherical, the force exerted by these charges is the same as that of two point charges at the center of the particles, q and Q, and the attractive force is given by Coulomb's law:

$$F_{Cout}=qQ/r^2 \tag{1}$$

where r is the distance between the centers of the particles. This force is negative if the charges are attracted, positive if they repel, and is directed in a straight line from one particle to the other. The potential energy U of the system of two charges is given by $$U=qQ/r \tag{2}$$

For charge Q, the potential energy for a unit charge at a distance r, or the potential, is given by the equation:

$$V=Q/r \tag{3}$$

with Q the source of the potential, and the electric field of charge Q can be found from the potential, as the negative derivative of the potential:

$$E=-\nabla V \tag{4}$$

For a system of pre-existing charges $q_i$ brought into proximity, the potential energy U can be found by summing over all interactions except those of self-assembly, i.e. the sum does not include interaction of a point charge $q_i$ with its own Coulomb potential $q_i/r$, which represents the energy required to assemble the charge $q_i$. The potential energy for a system of point charges is given by Equation (5)

$$U = \frac{1}{2}\sum_{i,j} q_i V_j \tag{5}$$

In electrographic development, the toner particles 50 contact the carrier particles 52 and acquire a charge q through tribocharging. An equal and opposite charge Q=−q is initially distributed on the surface of the carrier particle 52. Thus, for spherical particles with uniform surface charge distributions, the force between the particles from the free charges is as if the charge q and Q were concentrated in the center of each respective particle and is given by Equation (1), with $r \geqq R_C + R_{CT}$.

In actual practice, however, additional forces are present, arising from polarization of the particles. Moreover, there are two sources of polarization. First, the charge of each particle induces polarization in an adjacent particle, i.e., the charge on the toner particle 50. induces polarization in carrier particle 52. For ease of discussion, this will be referred to herein as "charge induced polarization." Second, polarization also arises from external electric fields, such as the external electric field of image development. This external electric field is approximately constant over the dimensions of a carrier 52 or toner 50 particle and also exerts a force qE on the toner particle. These additional electrical forces and their contribution to the overall forces exerted by the toner particle 50 and carrier particle 52 are superimposed on the Coulomb force.

Charge induced polarization will be addressed in the case of a conductive carrier particle and a dielectric carrier particle. At the outset, it should be noted that dielectric carrier particles having a very high dielectric constant behave similarly to conductive particles in some respects but have advantages due to their large but finite dielectric constant. Charge induced polarization reduces the potential energy of the system and increases the attractive force between the particles. FIG. 4 depicts a toner particle 50 adjacent a carrier particle 52, where the carrier particle 52 has a much larger diameter than the toner particle 50, to the extent that the carrier particle 52 may be represented as a flat, conductive, grounded plane adjacent the toner particle 50. The charge on the toner particle 50, q, induces an electrostatic image charge, −q, in the conductor particle 52. This electrostatic image charge is to be distinguished from the electrographic image charge carried by the photoconductor 12. In actuality, the electrostatic image charge is a distribution of free charges on the surface of the carrier particle 52, but may be represented as the electrostatic image charge shown in FIG. 4. At the limit, for a very large carrier particle 52 of essentially infinite radius, that is a perfect conductor, and for a toner particle 50 with charge uniformly distributed on its surface and approximated as a point charge, the force due to the electrostatic image charge is given by:

$$F_{Pt\text{-}Cond\ Plane} = -\frac{q^2}{4(R_T + s)^2} \tag{6}$$

and the potential energy is $$U_{Pt\text{-}Cond\ Plane} = -\frac{q^2}{4(R_T + s)} \tag{7}$$

where s is the separation between the particles. The point-plane model is also a good approximation for very large carriers that have high but finite conductivity or a very large dielectric constant >>1. For a large carrier with dielectric constant $\in_C$, $$F_{Pt\text{-}Diel\ Plane} = -\left(\frac{\varepsilon_C - 1}{\varepsilon_C + 1}\right)\frac{q^2}{4(R_T + s)^2}. \tag{8}$$

and $$U_{Pt\text{-}Diel\ Plane} = -\left(\frac{\varepsilon_C - 1}{\varepsilon_C + 1}\right)\frac{q^2}{4(R_T + s)} \tag{9}$$

For typical toner characteristics, such as a toner charge of 20 $\mu$C/g, average toner diameter of 11.5 microns, and density of approximately 1 g/cc, the toner has a charge of approximately $4.78\times10^{-5}$ statcoulombs, and the force from the electrostatic image charge for a toner particle 50 in contact with a conductive carrier particle 52 represented as a plane surface is approximately $-1.73\times10^{-3}$ dynes. However, given that the sizes of the toner and carrier particles are relative, toner of larger or smaller diameter may be employed in this invention. The electrostatic potential energy binding the toner particle 50 to a conductive carrier particle 52 is approximately $-9.93\times10^{-7}$ ergs. For large dielectric carrier with large values of $\in_C$, the force and potential are approximately the same as for large conductive carriers.

In the more realistic case shown in FIG. 5 of a spherical carrier particle 52, a toner particle 50 tribocharged on the surface of the carrier particle 52 acquires a charge q uniformly distributed on its surface, while the carrier particle 52 acquires charge Q. The center of the toner particle 50, with charge q, is at radius r from the center of the carrier particle 52. At least initially, the particle charges are equal and opposite, such that Q=−q. If the carrier is conductive, a portion of its total charge Q concentrates on the surface of the carrier particle 52 adjacent the toner particle 50, indicated by 54, resulting in a non-uniform charge distribution. This produces forces that are identical to those that would result from an electrostatic image charge of $q' = -qR_C/r$ inside the carrier particle 52 at a distance of $R_C^2/r$ from the center of the carrier in the r direction, and from excess charge $Q' = Q - q' = -q(1 - R_C/r)$ at the center of the carrier particle 52. When the toner particle 50 is close to the carrier particle 52, the electrostatic image charge is large and localized near the surface of the carrier particle 52, and the resulting attractive force is large. As the separation between the toner particle 50 and the carrier particle 52 increases, the electrostatic image charge decreases in magnitude and moves toward the center of the carrier particle 52, decreasing the attractive force and increasing the magnitude of the charge in the center of the carrier particle 52.

Thus, for a conductive carrier particle 52 and point charge toner particle 50, the attractive force due to the electrostatic image charge at $R_C^2/r$ alone is given by:

$$F = -\frac{q^2}{R_C^2}\left(\frac{R_C}{r}\right)^3\left(1 - \frac{R_C^2}{r^2}\right)^{-2} \tag{10}$$

Including the remaining charge Q−q' on the carrier particle 52, the total electrostatic force on the toner particle 50, a force that is greater than the Coulomb force $qQ/r^2$, is given by:

$$F_{Cond} = -\frac{q^2}{R_C^2}\left(\frac{R_C}{r}\right)^3\left(1 - \frac{R_C^2}{r^2}\right)^{-2} + \frac{q}{r^2}\left(Q + q\frac{R_C}{r}\right) \tag{11}$$

and

-continued $$U_{Cond} = -\frac{q^2}{2R_c}\left(\frac{R_C}{r}\right)^2\left(1-\frac{R_C^2}{r^2}\right)^{-1} + \frac{q}{r}\left(Q + q\frac{R_C}{2r}\right) \tag{12}$$

For a dielectric carrier particle 52, the distribution of charges is different. Polarization from an adjacent toner particle 50 produces a bound surface charge distribution and a bound internal charge distribution on the carrier particle 52, that cannot be depicted as individual electrostatic image charges. For source charge q at distance r, the potential at $r'>R_C$ is given by $$V_{Diel} = -\frac{q(\varepsilon_C - 1)R_C}{rr'}\sum_{n=1}^{\infty}\frac{n}{n\varepsilon_C + n + 1}\left(\frac{R_C^2}{rr'}\right)^n P_n(\cos\gamma) \tag{13}$$

where $\gamma$ is the angle between r and r', and $P_n(\cos\gamma)$ are Legendre's polynomials. For y=0, $P_n(\cos\gamma)=1$. This equation is symmetrical if the source charge is at location r or at location r'.

A toner particle 50 tribocharged on a dielectric carrier produces a free charge on the surface of the carrier particle 52 of magnitude Q=−q, and the potential energy for a spherical dielectric carrier particle 52 having a dielectric constant $\in_C$ and charge Q interacting with a toner particle 50 represented as a point charge of magnitude q is given by:

$$U_{Diel} = -\frac{q^2(\varepsilon_C - 1)R_C}{2r^2}\sum_{n=0}^{\infty}\frac{n}{n\varepsilon_C + n + 1}\left(\frac{R_C}{r}\right)^{2n} + \frac{qQ}{r} \tag{14}$$

The total force on a point toner particle 50 from a dielectric carrier particle 52, including both charge induced polarization and the Coulomb force is given by:

$$F_{Diel} = \frac{-2q^2(\varepsilon_C - 1)R_C}{2r^3}\sum_{n=0}^{\infty}\frac{n}{n\varepsilon_C + n + 1}\left(\frac{R_C}{r}\right)^{2n} - \frac{q^2(\varepsilon_C - 1)}{2r^2}\sum_{n=0}^{\infty}\frac{2n^2}{n\varepsilon_C + n + 1}\left(\frac{R_C}{r}\right)^{2n+1} + \frac{qQ}{r^2} \tag{15}$$

As discussed above, for very large dielectric carriers having a very high dielectric constant, such forces are approximately as discussed for very large conductive carriers. For carriers of finite size, however, the forces are as represented diagrammatically in FIGS. 6 and 7, which illustrate the effects of varying the relative size of the toner and carrier particles. FIG. 6 is a plot of the force exerted on a point toner particle of charge q by spherical conductive and dielectric carrier particles of charge Q=−q, with the toner and carrier particles in contact, for a range of carrier dielectric constants $\in_C$. FIG. 7 is a log-log plot of the force exerted on a point toner particle by spherical conductive and dielectric carrier particles with large dielectric constant $\in_C$, as a function of distance from the center of the carrier particle. The curves plotted represent carrier particles ranging in radius from 1 to 30 times the radius of the toner particle.

FIG. 6 shows that the contact force for point-charge toner with a dielectric spherical carrier particle is always less than for the conductive carrier particle and greater than the Coulomb force. The force for the dielectric carrier is greatest for small carrier particles of $R_C$ approximately equal to $R_T$. For larger dielectric carriers, the force approaches the limit of the image force from a dielectric plane surface.

The data in FIG. 6 for dielectric carriers was calculated using the first 200 terms for the summations of Equation (15). Very similar results are obtained if the force is calculated from the slope of the potential energy given by Equation (14). The potential energy given by Equation (14) will converge for $r>R_C$. Good agreement is obtained for forces calculated using Equation (15) and forces calculated by numerically evaluating the slope of the potential energy curve resulting from Equation (14) if a reasonable number of terms are used for each summation so that the $n^{th}$ term is much smaller than the $1^{st}$ term.

To optimize toning, the qE force on a toner particle from the electrostatic field for image development must be as large as possible in comparison to the attractive force binding the toner to the particle. This can be obtained with carrier particles having radius $R_C$ such that $R_C \geqq 1.5R_T$ in combination with a large dielectric constant. The preferred large dielectric constant results in an imaging electric field that is for practical purposes as large as that resulting from carrier that is conductive.

For example, assuming that 60% of the volume in the toning nip is occupied by carrier, for a voltage differential V between the photoconductor 12 and toning shell 18 a distance L apart, the imaging electric field is approximately given by E=V/((1−0.6)L). This assumes that conductive carrier particles can be approximated by thin sheets of conductive material. The effective dielectric constant is $\in_{eff}$=[V/((1−0.6)L)]/[V/L]=1/(1−0.6)=2.5. For the Weiner theory for the dielectric constant of mixtures, in the series or layer limit, $$\varepsilon_{eff} = \frac{\varepsilon_2}{\varepsilon_2 + \delta(1 - \varepsilon_2)} \tag{16}$$

where $\in_2$ is the dielectric constant of the carrier particles and $\delta$ is the packing density of the particles in the toning nip. As mentioned previously, the dielectric constant for commercial Heidelberg Digital carrier is approximately $5\times10^3$. A dielectric constant of 6 at 60% packing will decrease the effective dielectric constant by 20%, resulting in a reduction of the electric field of image development by 20%, but also reduce the attractive force by 10% to 29%, depending on n, where n is the ratio of carrier radius to toner radius. A dielectric constant of 3 will decrease the effective dielectric constant and the electric field by 33%, but reduce the attractive force by 16% to 50%. For carrier particles, a range for dielectric constant from 6 to ∞ can be used. Similar results are obtained using the Maxwell-Wagner model.

Returning to the discussion of interparticle forces, as can be seen from the curves plotted in FIG. 7, for large carrier particles, the force and potential change very rapidly with distance r, while for smaller carrier particles, the force decreases much more slowly. Each curve corresponds to toner separation distances ranging from contact with the carrier surface to separations of 10 toner radii between the particle surfaces. For larger carrier particles ~30× the toner diameter, the force can decrease more rapidly than $1\times/r^{30}$, behaving similarly to a surface force. For relatively small carrier particles of 1× to 5× the toner diameter, i.e., where $R_C$ is less than about $5R_T$ to about $10R_T$ the forces from tribocharge and charge induced polarization approach $1/r^2$ to $1r^3$ dependence at modest separations. For reference, the Coulomb force is also plotted in FIG. 7. Coulomb behavior is represented by a straight line of negative slope on log-log plots because of the 1/r dependence for the force and the $1/r^2$ dependence for the potential, with y-intercept $2\log_{10}(q)$.

The forces and potentials given by Equations (11), (12), (14), and (15) are proportional to $q^2$. For example, for a charge q other than $4.78\times10^{-5}$ statcoulombs, at a fixed toner diameter of 11.5 microns, the force will be $q^2/(4.78\times10^{-5})^2$ times that shown in FIGS. 6 and 7. If distance is measured in units of toner radius $R_T$, the forces of Equations (11) and (15) are proportional to $q^2/R_T^2$ and the potentials given by Equations (12) and (14) are proportional to $q^2/R_T$. If toner radius is changed and the ratio of toner charge-to-radius is kept constant, the force remains as shown in FIGS. 6 and 7.

The forgoing discussion has used the Coulomb force and forces due to charge induced polarization of the carrier by the toner to calculate the toner-carrier attractive force. The contribution to the toner-carrier attractive force from polarization of the toner by the charge of the carrier is much smaller and can be neglected in this approximation, where the dielectric constant $\in_T$ of the resinous toner is approximately 3.

The discussion to this point has omitted any consideration of qE forces and polarization due to external electric fields, such as the external electric field present in electrographic image development. For a conductive carrier particle, these additional electrical forces and their contribution to the overall forces exerted by the toner particle 50 and carrier particle 52 are additive to the forces of Equation (11). For a dielectric carrier particle, these additional forces are additive to the forces of Equation (15). The forces in Equations (11) and (15) contain the Coulomb contribution to the toner-carrier attractive force.

The attractive force between toner particles and carrier particles increases if a portion of the toner charge is concentrated near the point of contact of the toner particle and the carrier particles, as shown for a conductive carrier particle in FIG. 8, with the charge on the toner represented as point charges. The situation depicted in FIG. 3 corresponding to a uniform free charge on the toner surface will produce the smallest attractive force between the particles. Conversely, the configuration depicted in FIG. 8, illustrating a toner particle 50 in contact with a carrier particle 52, causing a non-uniform, concentrated charge distribution, results in a larger attractive force between particles.

Assuming that there is more than one toner particle per carrier particle, the charge distribution on the carrier particle surface can be assumed to be approximately constant. If x is the fraction of the total toner charge q that is concentrated at a point on the surface, a fraction (1−x) of the toner charge can be treated as concentrated at the center of the particle, having magnitude $q_1=q(1-x)$. The charge concentrated on the surface has magnitude $q_2=qx$.

In this case, for conductive carrier, the force between the toner particle and the carrier particle is given by Coulomb's law, summed over all interactions between the two charges on the toner particle and the three image charges "within" the carrier particle. The image charge in the carrier particle corresponding to the uniform charge $q_1=q(1-x)$ on the toner particle is of magnitude $q_1'=-q(1-x)R_C/r$ at a distance of $R_C^2/r$ from the center of the carrier particle 52 in the r direction. The image charge in the carrier particle corresponding to the concentrated charge $q_1=qx$ on the toner particle surface is of magnitude $q_2'=-qxR_C/(r-R_T)$ at a distance of $R_C^2/(r-R_T)$ from the center of the carrier particle 52 in the r direction. The image charge in the center of the carrier particle is $Q'=Q-q_{1'-q2}'$. If carrier particle 52 has total charge Q=−q, then the image charge in the center $Q'=-q+q(1-x)R_C/r+qxR_C/(r-R_T)$. When the toner particle 50 is in contact with the carrier particle 52 and the concentrated fraction of the toner charge is adjacent the carrier particle, in this approximation, the force is infinite. It can be evaluated for a small separation distance from the carrier particle, such as at $s=0.05R_T$.

The force for toner of charge q with charge $q_2=qx$ concentrated at the surface and charge $q_1=q(1-x)$ distributed uniformly on the surface, adjacent conductive carrier of charge Q, is given by Equation (17):

$$F_{CondNonunif}=\frac{\left(Q+\frac{qxR_C}{r-R_T}+\frac{q(1-x)R_C}{r}\right)qx}{(r-R_T)^2}+\frac{\left(Q+\frac{qxR_C}{r-R_T}+\frac{q(1-x)R_C}{r}\right)q(1-x)}{r^2}-\frac{\left(\frac{q(1-x)R_C}{r}\right)qx}{(r-R_T-R_c^2/r)^2}-\frac{\left(\frac{q(1-x)R_C}{r}\right)q(1-x)}{(r-R_c^2/r)^2}-\frac{\left(\frac{qxR_C}{r-R_T}\right)qx}{(r-R_T-R_C^2/(r-R_T))^2}-\frac{\left(\frac{qxR_C}{r-R_T}\right)q(1-x)}{(r-R_C^2/(r-R_T))^2} \tag{17}$$

For a dielectric carrier particle and a toner particle with charge $q_2=qx$ concentrated at the surface and charge $q_1=q(1-x)$ at the center, the potential energy equals the potential energy for $q_1$ and for $q_2$ due to the potential of the uniform charge $q_1$, plus the potential energy of both charges $q_1$ and $q_2$ due to the potential of the concentrated charge $q_2$, plus the Coulomb potential for the interaction of the carrier charge Q and the toner charges $q_1$ and $q_2$.

$$U_{DielNonuniform}=-\frac{q^2(1-x)^2(\varepsilon_C-1)R_C}{2r^2}\sum_{n=0}^{\infty}\frac{n}{n\varepsilon_C+n+1}\left(\frac{R_C}{r}\right)^{2n}-\frac{q^2x(1-x)(\varepsilon_C-1)R_C}{r(r-R_T)}\sum_{n=0}^{\infty}\frac{n}{n\varepsilon_C+n+1}\left(\frac{R_C^2}{r(r-R_T)}\right)^{n}-\frac{q^2x^2(\varepsilon_C-1)R_C}{2(r-R_T)^2}\sum_{n=0}^{\infty}\frac{n}{n\varepsilon_C+n+1}\left(\frac{R_C}{r-R_T}\right)^{2n}+\frac{Qq(1-x)}{r}+\frac{Qqx}{r-R_T} \tag{18}$$

The force can be found by differentiation.

$$F_{DielNonuniform}=\frac{-2q^2(1-x)^2(\varepsilon_C-1)R_C}{2r^3}\sum_{n=0}^{\infty}\frac{n}{n\varepsilon_C+n+1}\left(\frac{R_C}{r}\right)^{2n}-\frac{q^2(1-x)^2(\varepsilon_C-1)}{2r^2}\sum_{n=0}^{\infty}\frac{2n^2}{n\varepsilon_C+n+1}\left(\frac{R_C}{r}\right)^{2n+1}-\frac{-2q^2x^2(\varepsilon_C-1)R_C}{2(r-R_T)}\sum_{n=0}^{\infty}\frac{n}{n\varepsilon_C+n+1}\left(\frac{R_C}{r-R_T}\right)^{2n}-\frac{q^2x^2(\varepsilon_C-1)}{2(r-R_T)^2}\sum_{n=0}^{\infty}\frac{2n^2}{n\varepsilon_C+n+1}\left(\frac{R_C}{r-R_T}\right)^{2n+1}-\frac{q^2x(1-x)(\varepsilon_C-1)R_C(2r-R_T)}{r^2(r-R_T)^2}\sum_{n=0}^{\infty}\frac{n}{n\varepsilon_C+n+1}\left(\frac{R_C^2}{r(r-R_T)}\right)^{n}-\frac{q^2x(1-x)(\varepsilon_C-1)}{r(r-R_T)R_C}\sum_{n=0}^{\infty}\frac{n^2(2r-R_T)}{n\varepsilon_C+n+1}\left(\frac{R_C^2}{r(r-R_T)}\right)^{n+1}+\frac{Qq(1-x)}{r^2}+\frac{Qqx}{(r-R_T)^2} \tag{19}$$

Concentrations of charge significantly increase the force of attraction between toner particles and carrier particles.

For dielectric and conductive carrier particles, the force on a toner particle with 10% of the toner charge concentrated at a point adjacent the carrier is shown in FIG. 9 for a separation distance of 0.05 toner radii between the surfaces of the toner particle and carrier particle. Similarly to FIG. 6, the force for the conductive carrier particle is always greater than the force for the dielectric carrier particle. The force in FIG. 9 for the dielectric carrier particle and toner with concentrated charge decreases as carrier diameter is increased, but is always much greater than the force for the corresponding dielectric carrier with a uniformly charged toner as shown in FIG. 6. Maintaining uniform charge on the toner particles and minimizing concentrations of charge significantly reduces the force required for removing the toner from the carrier.

The data in FIG. 9 for dielectric carriers was calculated using the first 200 terms for the summations of Equation (19). Very similar results are obtained if the force is calculated from the slope of the potential energy given by Equation (18). The potential energy given by Equation (18) will converge for $r-R_T>R_C$. Good agreement is obtained for forces calculated using Equation (19) and forces calculated by numerically evaluating the slope of the potential energy curve resulting from Equation (18) if a reasonable number of terms are used for each summation so that the $n^{th}$ term is much smaller than the $1^{st}$ term. For small carriers with $R_C$ approximately equal to $3R_T$, good convergence is obtained with 200 terms for each summation, particularly for Equation (18). Increasing the number of terms by 50% does not significantly change the values for attractive force for carriers with $R_C$ approximately between $R_T$ and $5R_T$ in size.

A significant difference between the potential energy for a dielectric carrier and for a conductive carrier is that the $q_1q_2$ terms, which are proportional to $q^2x(1-x)$) and describe the interaction between $q_1$, and $q_2$, are symmetrical for a dielectric carrier particle of finite size if either $q_1$, or $q_2$ is considered to be the source. This is not true for conductive carrier. Combined with the fact that the potential energy for a charge adjacent a conductive carrier particle is greater in magnitude than the analogous potential energy for a dielectric carrier of finite dielectric constant, this symmetry results in lower attractive forces for toner having a nonuniform charge distribution adjacent a dielectric carrier particle than for the toner with nonuniform charge adjacent a conductive carrier particle.

Although FIG. 9 shows as much as a 25% decrease in attractive forces for large carrier particles having $R_C$ of approximately $30R_T$ in comparison with smaller carrier particles, the preferred carrier particle size is only a few times larger than the size of the toner particles because in the preferred range of carrier size, the likelihood is significantly reduced for having a large concentration of charge on the toner surface. The relative sizes of the carrier particles and toner particles is important in minimizing non-uniform charge distribution resulting from toner particles contacting carrier particles over only a small portion of their surface, a phenomenon that, to some extent is affected by the amount of free volume in the toning nip 34, in reference to FIGS. 1 and 2, which, in turn, determines how the developer packs together under the pressures exerted in the toning nip 34. Free volume in the toning nip 34 may be calculated by assuming that the volume in the toning nip 34 is limited by the 25 actual spacing of the photoconductor 12 from the toning shell 18 of 0.018", calculating the actual volume occupied by each developer particle, and dividing this volume by the packing fraction, f, for dense randomly packed spheres. For very dense packing, f~0.6. The toner and carrier particles are assumed to be spherical, and their volume is given by the equations:

$$V_T=(4/3)\pi R_T^3 \tag{20}$$

$$V_C=(4/3)\pi R_C^3 \tag{21}$$

The number of toner particles in a given unit area of developer, $N_T$, and the number of carrier particles in a given unit area of developer, $N_C$, are given by the following equations:

$$N_T=DMAD\times TC/(\rho_T V_T) \tag{22}$$

$$N_C=DMAD\times(1-TC)/(\rho_C V_C) \tag{23}$$

where DMAD is the developer mass area density, TC is toner content of the developer, $\rho_T$ is density of the toner particles and $\rho_C$ is density of the carrier particles. Given these values, free volume may calculated by the following equation:

$$V_F=1-(kN_TV_T+N_CV_C)/(fL) \tag{24}$$

where L is the spacing between the photoconductor 12 and the toning shell 18 and k is the interstitial toner fraction, ie., the fraction of the toner particles that do not fit within the interstitial spaces between the carrier particles and, therefore, contribute to the volume taken up by the developer 16. For toner particles of diameter greater than about 41% of the carrier particle diameter (or carrier particles with diameter or radius less than approximately 2.4 toner diameter or radii) k~1, and for the toner used in experiments reported herein and for these calculations, it was assumed that k=1. For toner particles having a much smaller diameter relative to the diameter of the carrier particles, the packing structure of the developer particles in the nip would be determined entirely by the carrier particles, and the toner particles would not contribute to the developer volume.

Outside the toning nip 34, the developer nap is not subjected to the compression forces present in the toning nip 34 and, therefore, the packing fraction, f, is less than 0.6. It may be assumed that the packing structure of the nap outside the toning nip 34 results from magnetic attraction by the carrier particles and that relatively large toner particles will occupy voids in the packing structure of the carrier particles approximately equal in size to that of a carrier particle. Thus:

$$V_F=1-(kN_{Tj}V_C+N_CV_C)/(fH) \tag{25}$$

where H is the measured nap height and j is the fraction of a carrier volume occupied by a toner particle. For the present embodiment, j=0.6.

The amount of available free volume, both in and out of the toning nip, is largely dependent on the degree to which the toner particles are able to fit into the voids created in packing of the carrier particles. If the toner particles are smaller than the voids created by the packing of the carrier particles, the volume taken up by the developer is almost entirely dependent on the carrier particles. It may be seen, however, that, as the diameter of the toner particles increases relative to the diameter of the carrier particles, the ability of the toner particles to fit into the voids in the carrier particle packing structure diminishes and the toner particles increasingly contribute to the overall developer volume, decreasing free volume.

In the case of toner/carrier interactions, non-uniform charging results primarily from toner particles contacting carrier particles with only a limited portion of the toner particle surface. As the developer is agitated by the formation and collapse of carrier particle chains, the carrier particles form clusters, each having an inner void. Several void structures are observed with packed spheres. When the carrier particle chains collapse on the surface of the toning shell, the particles form a structure that may be described by a model based on discrete voids or a by a continuous void model, but the structure approximates a dense randomly packed hard spheres (DRPHS) structure. In the discrete void model, the following voids are present, as depicted in FIGS. 10*a–e*, in the relative frequencies indicated: (a) tetrahedron, 86.2%; (b) octahedron, 5.9%; (c) trigonal prism capped with three half octahedra, 3.8%; (d) archimedean antiprism capped with two half octahedra, 0.5%; and (e) tetragonal dodecahedron, 3.7%. It should be noted that the idealized structures presented in FIGS. 10*a–e* are somewhat distorted in the actual carrier particle structure. Alternatively, the voids may be modeled as a continuous distribution for monodisperse particles or for particles having a distribution of sizes described by a Schulz distribution with parameter z using the method of Lu and Torquato described in Torquato, S., Lu, B., and Rubinstein, J. "Nearest-neighbor distribution functions in many-body systems" in *Phys. Rev. A*, Vol. 41, No. 4 (15 Feb. 1990) p. 2059 et seq., which is incorporated by reference herein in its entirety, and as described in Lu, B. and Torquato, S. "Nearest-surface distribution functions for polydispersed particle systems" in *Phys. Rev. A*, Vol. 45, No. 8 (15 Apr. 1992) p. 5530 et seq., which is incorporated by reference herein in its entirety.

FIG. 11 shows the size distribution for continuous and discrete voids for randomly packed spheres of radius 1. Packing fraction for the discrete void model is 0.6 and for the continuous void model ranges from 0.6 to 0.2. For a toner particle of radius x, the y-axis of FIG. 11 shows that percentage of voids that particle may occupy without distorting the packed structure or touching more than one carrier particle at a time. Given the strong magnetic interactions between particles, the collapsed carrier chains are likely to form clusters in an overall structure that is intermediate to the discrete and continuous models.

If the toner particles are much smaller in diameter than the carrier particles or the packing fraction is significantly less than 0.6, the toner particles are much smaller than these void structures and easily fit within the void, resulting in the toner particle contacting a carrier particles at only one point, for example, as illustrated in FIG. 12. If, however, the toner particles are sized relative to the carrier particles such that the toner particles are large enough that they either just fit within the void or are slightly too large to fit within the void, and the packing fraction is maximized, contact between the toner particle and the carrier particles is also maximized, as shown in FIG. 12. To maximize contact with carrier particles at more than one location on the toner surface, toner having relative size in the range from approximately $\frac{1}{10}$ $R_C$ to $\frac{2}{3}$ $R_C$ is preferred, corresponding to carrier size in the range from approximately 1.5 $R_T$ to 10 $R_T$, and toner having relative size of approximately $\frac{2}{10}$ $R_C$ to $\frac{1}{2}$ $R_C$ is more preferred, corresponding to a carrier size range of approximately 2 $R_T$ to 5 $R_T$.

The importance of maximizing toner particle surface contact with carrier particles lies in the surface charge distribution that results from tribocharging. When a toner particle contacts a carrier particle only with a small portion of its surface, the small portion in intimate contact with the carrier particle actually acquires charge, as well as a point directly opposite the contact point, resulting in an uneven charge distribution on the surface of the toner particle. However, a spherical charge distribution is greatly favored, because the non-uniform charge distribution resulting from undersized toner particles can cause the electrostatic adhesion force to become dominant, making it more difficult to remove the toner particle from the first carrier particle.

The size distribution of particles is often described by a Schulz distribution, $$f(R) = \frac{1}{\Gamma(z+1)}\left[\frac{z+1}{<R>}\right]^{z+1} R^z \exp\left[\frac{-(z+1)R}{<R>}\right] \tag{26}$$

with z>−1. Size distributions for particles with <R>=½ and various z values are plotted in FIG. 13. Large values of z cause the distribution to become sharper and reduce the variance. For z→∞ the particles are monodisperse. Z=6 is characteristic of ground carrier particles. For the example toner, which is prepared by grinding, Z=20.

FIG. 14 shows that the carrier particle size distribution has an effect on the void size for dense random packing with packing fraction of approximately 0.6. Narrow particle size distributions with z>6 are preferred.

Spherical charge distribution may be achieved by using monodispersed, spherical, chemically developed toner particles having a narrow size distribution, rather than toners produced by grinding. Such chemically-produced toners are known in the art, and their use is preferred in practicing the instant invention. Moreover, the toner particles are preferably of the appropriate size relative to the carrier particles, as discussed above. If the typical toner size and typical carrier size satisfy the preferred size relationships, narrower size distributions will increase the percentage of toner and carrier particles that satisfy the preferred size relationships. Narrow toner particle size distributions with z>20 are preferred.

Additionally, the same advantages may be gained by the use of spherical, chemically developed carrier particles having a narrow size distribution, as this leads to spherical, uniform charge distribution on the carrier particles as well as the toner particles, and also to a large percentage of toner particles satisfying the preferred size relationship with the carrier particles.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof.

What is claimed is:

1. A two-component developer for use in electrographic printing comprising substantially spherical toner particles and substantially spherical magnetic carrier particles, the carrier particles having a dielectric constant $\in_C$ of at least about 6, the toner particles having a radius $R_T$ and the carrier particles having a radius $R_C$, wherein $R_C$ is between about $1.5R_T$ and about $10R_T$.

2. The developer of claim 1, wherein $R_C$ is between about $2R_T$ and about $5R_T$.

3. The developer of claim 1, wherein the carrier particles have a dielectric constant $\in_C$ greater than about 10.

4. The developer of claim 3, wherein $R_C$ is between about $2R_T$ and about $5R_T$.

5. The developer of claim 1, wherein the carrier particles have a dielectric constant $\in_C$ greater than about 100.

6. The developer of claim 5, wherein $R_C$ is between about $2R_T$ to about $5R_T$.

7. The developer of claim 1, wherein the carrier particles have a dielectric constant $\in_C$ greater than about 298.

8. The developer of claim 7, wherein $R_C$ is between about $2R_T$ to about $5R_T$.

9. The developer of claim 1, the carrier particles having a size distribution according to the Schulz distribution with z greater than about 6.

10. The developer of claim 1, the carrier particles having a size distribution according to the Schulz distribution with z greater than about 10.

11. The developer of claim 1, the carrier particles having a size distribution according to the Schulz distribution with z greater than about 50.

12. The developer of claim 1, the carrier particles having a size distribution according to the Schulz distribution with z greater than about 100.

13. The developer of claim 1, the toner particles having a size distribution according to the Schulz distribution with z greater than about 20.

14. The developer of claim 1, the toner particles having a size distribution according to the Schulz distribution with z greater than about 30.

15. The developer of claim 1, the toner particles having a size distribution according to the Schulz distribution with z greater than about 50.

16. The developer of claim 1, the toner particles having a size distribution according to the Schulz distribution with z greater than about 100.

17. A method for producing electrographic images comprising the steps of:

(a) providing an electrographic printer comprising an imaging member, a toning shell located adjacent the imaging member and defining an external electric field of image development therebetween, and a two-component developer, comprising substantially spherical toner particles and substantially spherical magnetic carrier particles, the carrier particles having a dielectric constant $\in_C$ of at least about 6, the toner particles having a radius $R_T$ and the carrier particles having a radius $R_C$, wherein $R_C$ is between about $1.5R_T$ and about $10R_T$; and (b) causing developer to move through the external electric field, interacting with an electrostatic image carried on the imaging member.

18. The method of claim 17, wherein $R_C$ is between about $2R_T$ and about $5R_T$.

19. The method of claim 17, wherein the carrier particles have a dielectric constant $\in_C$ greater than about 10.

20. The method of claim 19, wherein $R_C$ is between about $2R_T$ and about $5R_T$.

21. The method of claim 17, wherein the carrier particles have a dielectric constant $\in_C$ greater than about 100.

22. The method of claim 21, wherein $R_C$ is between about $2R_T$ to about $5R_T$.

23. The method of claim 17, wherein the carrier particles have a dielectric constant $\in_C$ greater than about 298.

24. The method of claim 23, wherein $R_C$ is between about $2R_T$ to about $5R_T$.

25. The method of claim 17, wherein the external electric field of image development is less than the electric field produced by a uniformly-charged toner particle of charge q and radius $R_T$.

* * * * *